US009214764B2

(12) United States Patent
Hsu

(10) Patent No.: US 9,214,764 B2
(45) Date of Patent: Dec. 15, 2015

(54) ELECTRICAL CONNECTOR HAVING ALIGNMENT KEY ASSEMBLED THEREON

(71) Applicant: HON HAI PRECISION INDUSTRY CO., LTD., New Taipei (TW)

(72) Inventor: Shuo-Hsiu Hsu, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/296,908

(22) Filed: Jun. 5, 2014

(65) Prior Publication Data

US 2014/0364002 A1 Dec. 11, 2014

(30) Foreign Application Priority Data

Jun. 5, 2013 (TW) ..... 102210520 U

(51) Int. Cl.
*H01R 12/00* (2006.01)
*H01R 13/645* (2006.01)

(52) U.S. Cl.
CPC ..... *H01R 13/645* (2013.01)

(58) Field of Classification Search
CPC ..... H01R 12/7005; H01R 13/629; H01R 13/514; H01R 4/027; H01R 12/7052
USPC ..... 439/71, 73, 68, 330, 331, 680, 681
See application file for complete search history.

(56) References Cited

U.S. PATENT DOCUMENTS

| | | | | |
|---|---|---|---|---|
| 7,207,808 | B2 | 4/2007 | Ma | |
| 7,789,672 | B2 * | 9/2010 | Fan et al. | 439/71 |
| 7,811,095 | B2 * | 10/2010 | Fan | 439/68 |
| 7,837,478 | B2 * | 11/2010 | Fan | 439/71 |
| 7,938,665 | B2 * | 5/2011 | Fan et al. | 439/326 |

* cited by examiner

*Primary Examiner* — Xuong Chung Trans
(74) *Attorney, Agent, or Firm* — Wei Te Chung; Ming Chieh Chang

(57) ABSTRACT

An electrical connector includes an insulating housing, a plurality of contacts retained in the insulating housing and an alignment key assembled the insulating housing. The insulating housing includes an accommodating portion defining a plurality of through holes. The alignment key is assembled on the accommodating portion. The alignment key includes a post and an extending portion extending downwardly from the post. The extending portion extends into the through holes optionally.

20 Claims, 7 Drawing Sheets

ELECTRICAL CONNECTOR HAVING ALIGNMENT KEY ASSEMBLED THEREON

BACKGROUND OF THE INVENTION

1. Field of the Invention

The present disclosure relates to an electrical connector, and more particularly to an electrical connector for connecting a Central Processing Unit (CPU) with a printed circuit board (PCB).

2. Description of the Related Art

Various electrical connectors are widely used in computer and other electronic devices. An electrical connector for electrically connecting a CPU to a printed circuit board (PCB) typically comprises an insulating housing for accommodating the CPU and a plurality of contacts retained in the insulating housing for contacting the CPU and the PCB. U.S. Pat. No. 7,207,808 issued to Ma on Apr. 24, 2007 discloses an electrical connector. The electrical connector comprises an insulating housing and a plurality of contacts retained therein. The insulating housing comprises a bottom wall and a plurality of side walls extending from the bottom wall. The bottom wall and the side walls define a cavity for receiving a CPU. The electrical connector further comprises an alignment key having a post portion extending into the cavity for matching with a cutout of the CPU to position the CPU onto the insulating housing correctly. The side wall comprises a recess for receiving the alignment key. However, as soon as the recess is formed, the structure of the alignment key is identified correspondingly. Therefore, the structure of the alignment key can not be changed to match with different CPUs whose cutouts are different.

In view of the above, an improved electrical connector is desired to overcome the problems mentioned above.

SUMMARY OF THE INVENTION

Accordingly, an object of the present disclosure is to provide an electrical connector capable of assembling different alignment keys and being easy to recognize the structure of the alignment key.

In order to achieve the object set forth, an electrical connector having alignment key assembled thereon is provided. The electrical connector comprises an insulating housing defining a cavity, a plurality of contacts retained in the insulating housing, and an alignment key assembled onto the insulating housing. The insulating housing comprises an accommodating portion for receiving the alignment key. The alignment key comprises at least one post extending into the cavity and at least one tail portion extending downwardly from the post. The accommodating portion comprises a plurality of through holes more than that of the tail portion so that the tail portion is capable of being assembled into the through holes optionally.

DESCRIPTION OF PREFERRED EMBODIMENT

Figure 1:
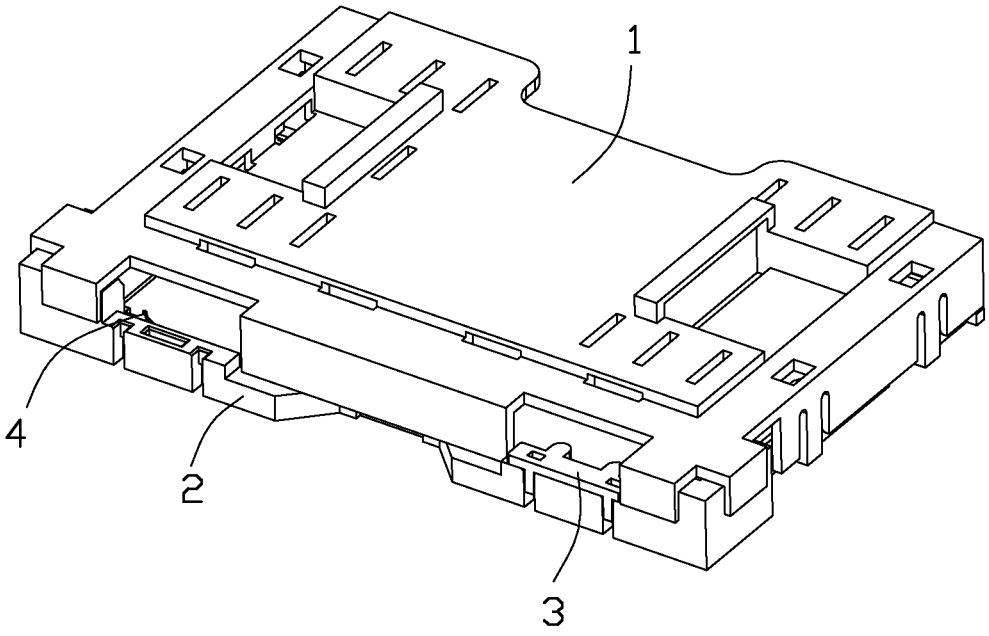
FIG. 1 is an assembled schematic view of an electrical connector assembly in accordance with a preferred embodiment of the present disclosure.
Figure 2:
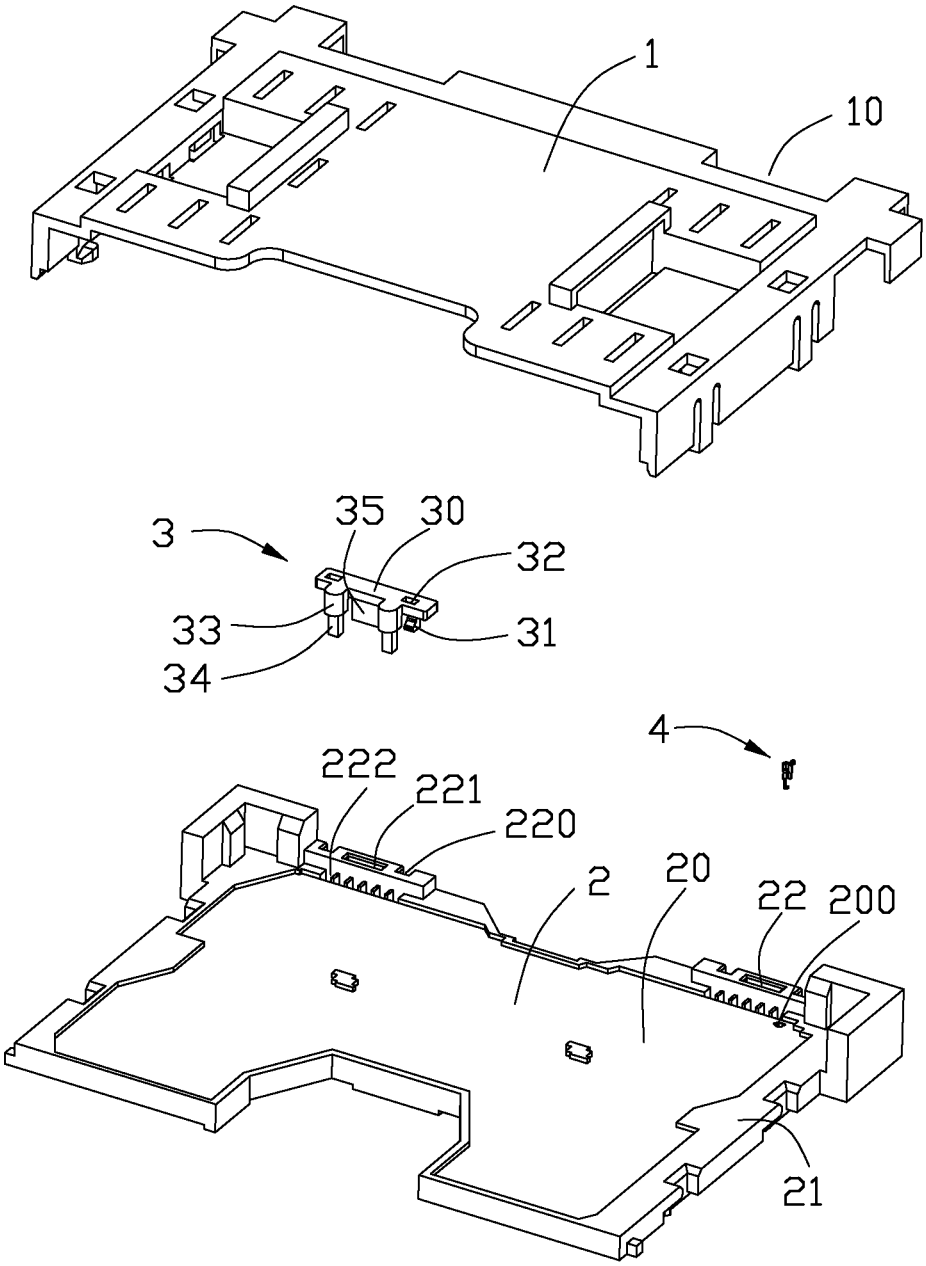
FIG. 2 is an exploded schematic view of the electrical connector assembly as shown in FIG. 1.
Figure 3:
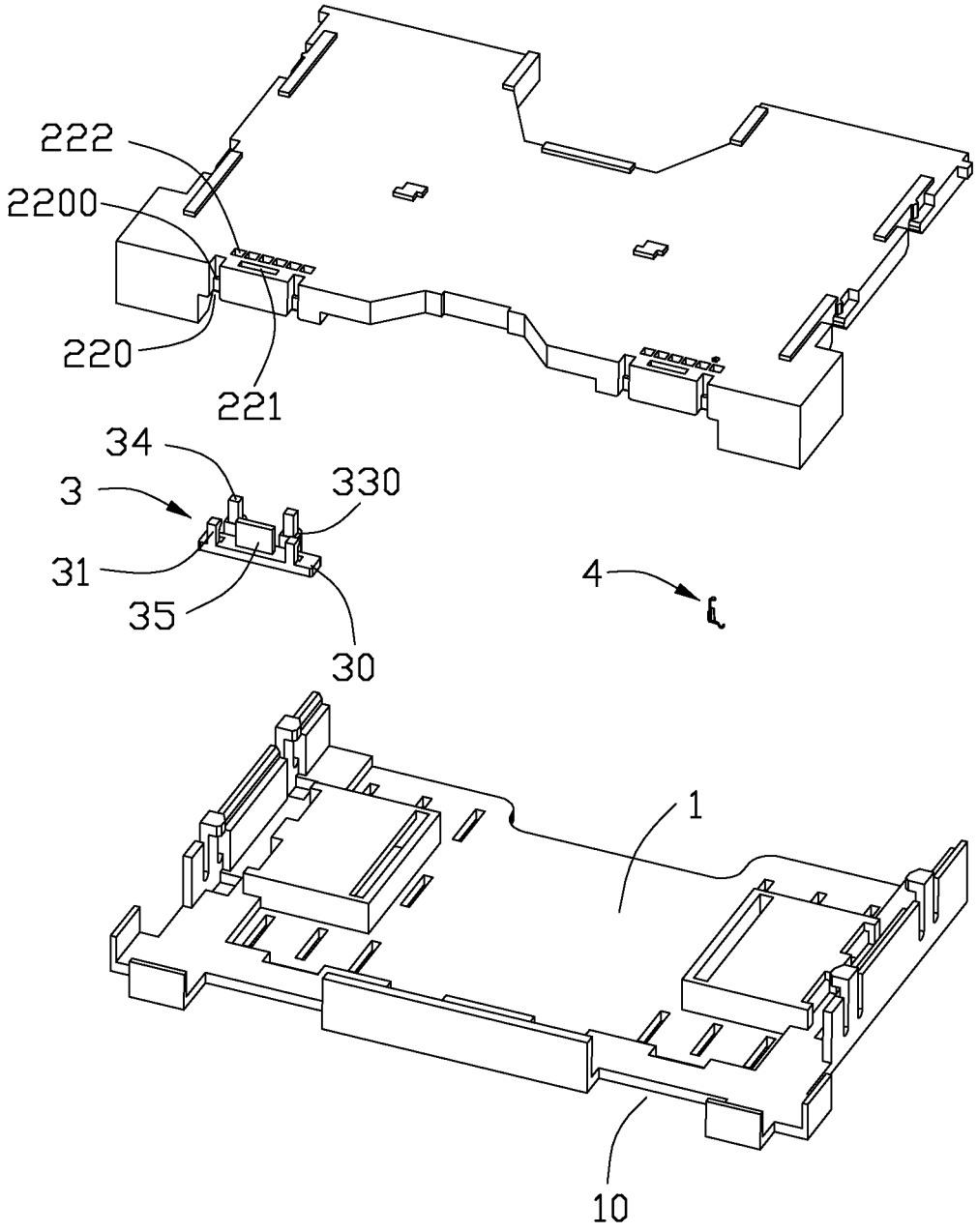
FIG. 3 is another exploded schematic view of the electrical connector assembly as shown in FIG. 1.
Figure 4:
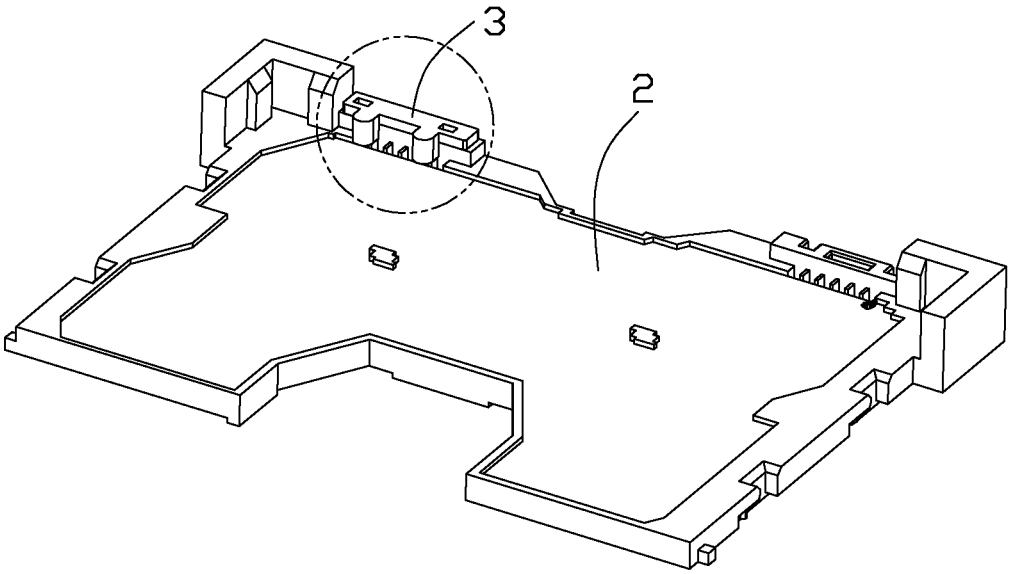
FIG. 4 is an assembled schematic view of the electrical connector as shown in FIG. 1.
Figure 5:
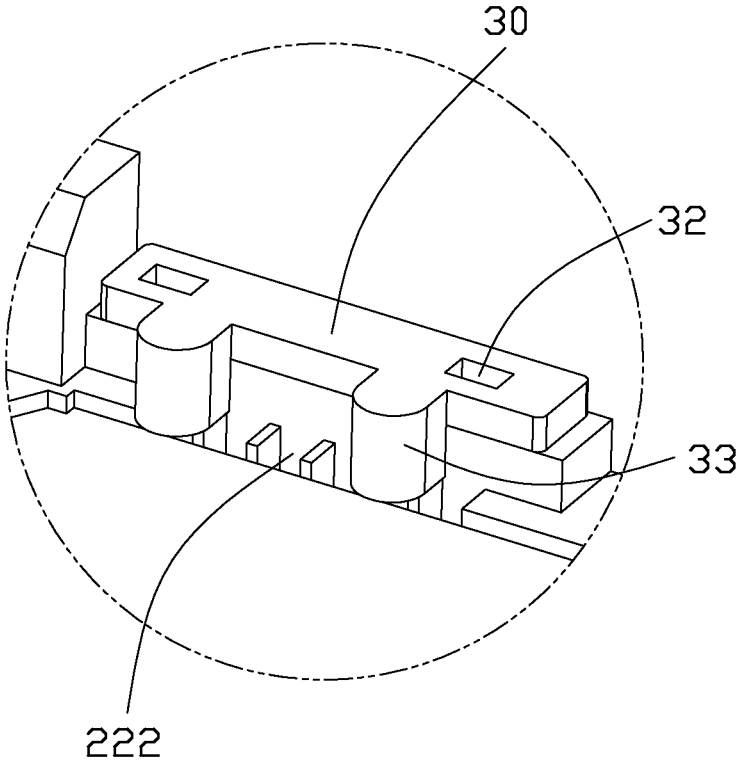
FIG. 5 is an enlarged view of the circular portion as shown in FIG. 4.

Reference will now be made to the drawings to describe the present disclosure in detail.

Referring to FIGS. 1 to 6, an electrical connector assembly for electrically connecting a CPU (not show) with a PCB (not show) is provided. The electrical connector assembly comprises an electrical connector and a cap 1 assembled on the electrical connector. The electrical connector comprises an insulating housing 2, a plurality of contacts 4 retained in the insulating housing 2 and at least one alignment key 3 assembled onto the insulating housing 2.

The insulating housing 2 defines a mating surface (not labeled) for supporting the CPU and a mounting surface (not labeled) opposite to the mating surface for being assembled on the PCB. The insulating housing 2 comprises a cavity 20 having the contacts 4 extending therein, a plurality of side walls 21 surrounding the cavity 20 and an accommodating portion 22 for retaining the alignment key 3. The cavity 20 defines a plurality of passageways 200 for receiving the contacts 4. The accommodating portion 22 comprises a pair of retention slots 220 on the outside of the side wall 21, a recess 221 extending downwardly from a top surface of the side wall 21, and a plurality of through holes 222 penetrating the mating and mounting surfaces of the insulating housing 2. The retention slot 220 defines a stepped portion 2200 facing downwardly. The recess 221 locates between the pair of the retention slots 220. The accommodating portion 22 comprises at least two through holes 222.

The alignment key 3 comprises a planner body portion 30, a pair of latches 31 extending downwardly from two opposite ends of the body portion 30 for retaining on the stepped portion 2200, an extending portion extending from a side of the body portion 30 into the cavity 20, and a protrusion 35 extending downwardly from the body portion 30 matching with the recess 221. The extending portion comprises a post 33 extending into the cavity 20 and above the mating surface, and a tail portion 34 extending downwardly from the post 33 into the through hole 222. The body portion 30 comprises a pair of openings 32 beside the latches 31 for increasing the elastic deformation of the latches 31. The post 33 and the tail portion 34 define an abutting surface 330 therebetween for abutting a top surface of the through hole 222. In this embodiment, the alignment key 3 comprises a pair of alignment posts 33 and tail/extending portions 34 aligned with and extending from the corresponding alignment posts, respectively. The amount of the through holes 222 is more than that of the tail portions 34. The tail portions 34 are optionally received in the through holes 222.

Figure 7:
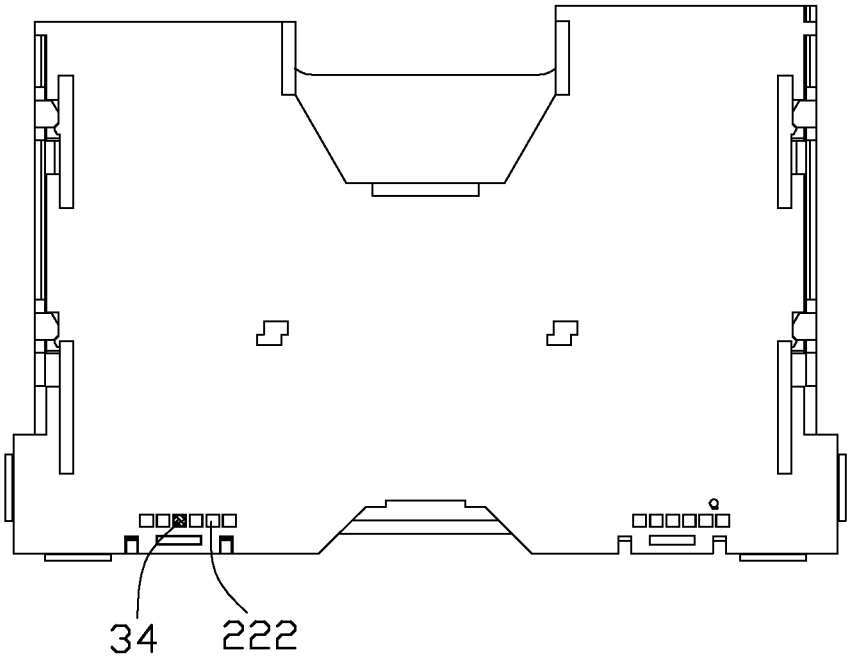
FIG. 7 is a bottom view of the electrical connector assembly in accordance with another embodiment of the present disclosure.

FIG. 7 shows another embodiment of the present disclosure. The position of the post 33' of the alignment key 3' in this embodiment is different from that of the preferred embodiment for matching CPU with different cutouts. In this embodiment, the alignment key 3' comprises one post 33'.

Figure 6:
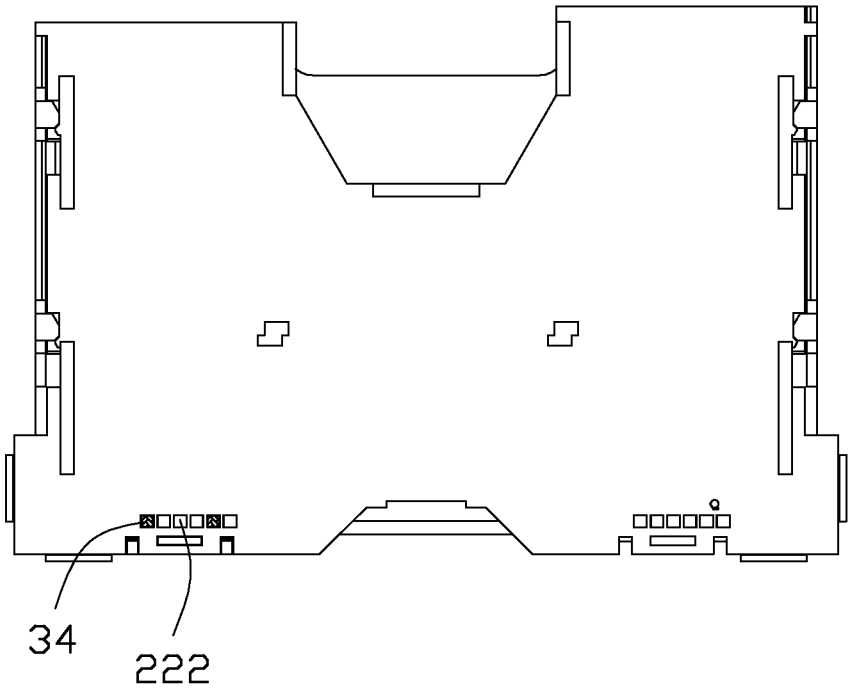
FIG. 6 is a bottom view of the electrical connector assembly as shown in FIG. 1.

According to the above described embodiments, an electrical connector having a plurality of through holes 222 for assembling different alignment keys 3, 3' with different posts 33, 33' is provided. Referring to FIGS. 6 and 7, as the tail portion 34 extends into the through hole 222, the position of the post can be recognized from bottom view. Moreover, the alignment key 3, 3' can be made from the material which has the different color with that of the insulating housing 2, or define a reflecting element on a bottom surface of the tail portion, for being easily recognized. The cap 1 assembled on the insulating housing 2 defines a gap 10 corresponding to the alignment key 3, 3', thus, light can go through the gaps 10 for recognizing the position of the post easily, and the post can be viewed from a top view.

Although the present disclosure has been described with reference to particular embodiments, it is not to be construed as being limited thereto. Various alterations and modifications can be made to the embodiments without in any way departing from the scope or spirit of the present disclosure as defined in the appended claims.

What is claimed is:

1. An electrical connector for electrically connecting a Central Processing Unit (CPU) having a cutout, comprising:

an insulating housing comprising a cavity and an accommodating portion beside the cavity;

a plurality of contacts retained in the insulating housing; and an alignment key assembled on the accommodating portion for matching with the cutout of the CPU, comprising a plurality of posts upwardly extending into the cavity; wherein the alignment key comprises a plurality of tail portions extending downwardly from the post while the accommodating portion comprises a plurality of through holes for receiving the tail portion, an amount of the through hole is more than that of the tail portions, the tail portions are inserted into the corresponding through holes, and an amount of the posts are same with that of the tail portions in a one-to-one relation; wherein the positions of the tail portions are variable corresponding to the corresponding posts, so as to be selectively inserted into different through holes, respectively, for identification purpose.

2. The electrical connector as claimed in claim 1, wherein the post and the tail portion define an abutting surface therebetween abutting a top surface of the through hole.

3. The electrical connector as claimed in claim 1, wherein the alignment key comprises a body portion and a latch extending downwardly from the body portion, the post extends from one side of the body portion.

4. The electrical connector as claimed in claim 3, wherein the accommodating portion comprises a retention slot on an outside of the side wall, the retention slot defines a stepped portion for engaging with the latch.

5. The electrical connector as claimed in claim 3, wherein the body portion comprises an opening beside the latch.

6. The electrical connector as claimed in claim 3, wherein the alignment key further comprises a protrusion extending downwardly from the body portion.

7. The electrical connector as claimed in claim 6, wherein the accommodating portion comprises a recess for receiving the protrusion.

8. The electrical connector as claimed in claim 1, wherein a cap is assembled on the insulating housing, the cap comprises a gap corresponding to the alignment key.

9. The electrical connector as claimed in claim 1, wherein the tail portion defines a reflecting element at a bottom surface thereon for being easily recognized.

10. The electrical connector as claimed in claim 1, wherein said posts are vertically aligned respectively with said tail portions in said one-to-one relation.

11. The electrical connector as claimed in claim 1, wherein the through holes without the tail portions therein, are upwardly exposed to an exterior without being covered by the alignment key.

12. An electrical connector for connecting a CPU with a PCB, comprising:

an insulating housing defining a mating surface for supporting the CPU and a mounting surface opposite to the mating surface for being assembled on the PCB, the insulating housing comprising a cavity and an accommodating portion beside the cavity, the accommodating portion defining a plurality of through holes penetrating the mating surface and the mounting surface; and an alignment key assembled on the accommodating portion; wherein the alignment key comprises a body portion and at least one extending portion extending from a side of the body portion, the extending portion extends into the cavity, and the alignment key is configured to cover only a part of the through holes so that a position of the extending portion can be easily recognized from the mounting surface.

13. The electrical connector as claimed in claim 12, wherein the extending portion comprises at least a post above the mating surface and a tail portion extending downwardly from the post and into at least one of the through holes.

14. The electrical connector as claimed in claim 13, wherein the tail portion defines a reflecting element at a bottom surface thereon for being easily recognized.

15. The electrical connector as claimed in claim 12, wherein the color of the alignment key is different from that of the insulating housing.

16. The electrical connector as claimed in claim 12, wherein a cap is assembled on the insulating housing, the cap comprises a gap corresponding to the alignment key so that the position of the post can be viewed from the mating surface.

17. An electrical connector comprising:

an insulative housing defining opposite upper mating surface and mounting surface with a receiving cavity therebetween in a vertical direction;

a plurality of contacts disposed in the housing with corresponding upper contacting sections exposed in the receiving cavity;

an insulative cap detachably mounted upon the housing to cover the receiving cavity; and an alignment key detachably assembled to a periphery wall of the housing beside the receiving cavity; wherein said alignment key includes a post upwardly extending into the receiving cavity, and a downwardly extending tail portion exposed upon the mounting surface for easy identification from the mounting surface; wherein the tail portion is aligned with the post in the vertical direction in a one-to-one relation; wherein the housing defines one row of through holes each extending in the vertical direction proximate said alignment key, and said tail portion is received within one of said through holes; wherein remaining through holes are not covered by the alignment key but upwardly exposed to an exterior in the vertical direction.

18. The electrical connector as claimed in claim 17, wherein the post is exposed to an exterior upwardly via a corresponding cutout in the cap for identification.

19. The electrical connector as claimed in claim 17, wherein said alignment further includes another upward extending post and another downwardly extending tail portion aligned with said another upwardly extending post in the vertical direction, and said another downwardly extending tail portion is received within another through hole of the remaining through holes.

20. The electrical connector as claimed in claim 17, wherein a position of said tail portion is variable.

* * * * *